United States Patent [19]

Hans

[11] 4,224,118

[45] Sep. 23, 1980

[54] METHOD OF MASKING PLATED ARTICLE WITH A POLY(ISOBUTYL METHACRYLATE) AND POLY(VINYL TOLUENE) CONTAINING COATING

[75] Inventor: Kenneth H. Hans, Alexandria, Ind.

[73] Assignee: General Motors Corporation, Detroit, Mich.

[21] Appl. No.: 72,052

[22] Filed: Sep. 4, 1979

[51] Int. Cl.[3] ..... C25D 5/02
[52] U.S. Cl. ..... 204/15
[58] Field of Search ..... 204/15, 20, 30

[56] References Cited

U.S. PATENT DOCUMENTS

| | | | |
|---|---|---|---|
| 3,451,902 | 6/1969 | Levinos | 204/15 |
| 3,772,161 | 11/1973 | Bogard | 204/15 |

*Primary Examiner*—T. M. Tufariello
*Attorney, Agent, or Firm*—Elizabeth F. Harasek

[57] ABSTRACT

A method is provided for electrolytically plating selected surface portions of a substrate by the application of a permanent stop-off coating. The coating comprises a fused mixture of poly(isobutyl methacrylate) and poly(vinyl toluene) resins. Well defined edges are provided between plated and unplated surface areas by the stop-off coating. Moreover, the coating is resistant to attack during plating and is adaptable, as is, for further processing operations after plating.

1 Claim, No Drawings

METHOD OF MASKING PLATED ARTICLA WITH A POLY(ISOBUTYL METHACRYLATE) AND POLY(VINYL TOLUENE CONTAINING COATING

BACKGROUND OF THE INVENTION

This invention relates to a method of plating selected surface areas of a plastic or metal part, the method incorporating a permanent polymeric stop-off material on the unplated portions. More particularly, the invention relates to the use of a permanent polymeric plating mask containing poly(isobutly methacrylate) and poly(-vinyl toluene).

The electrolytic deposition of metal coatings onto plastic or metal substrates is a well-known industrial art. It is often desirable, particularly where the metal coating is provided for decorative purposes, to plate only selected areas of the surface. Heretofore this has been done by masking the unplated portions with a temporary layer of a polymeric material. The polymeric mask is removed by mechanical or chemical means after plating.

One such masking method is set forth in U.S. Pat. No. 3,451,902. The patent describes a process of electrolytically coating an aluminum sheet wherein the polymeric stop-off material is an acrylic resin. The resin is nonsoluble in acid plating media, but easily removed in alkaline media having a pH of 7.5 or higher. Another method is proposed in U.S. Pat. No. 3,772,161. That patent relates to the application of vinyl toluene-butadiene copolymer masks on platable thermoplastic surfaces. After plating, the mask is removed by a solvent such as a 50/50 blend of mineral spirits and heptane.

Among the problems encountered by these methods have been poor adhesion, degradation, and erosion of the masking layer upon exposure to harsh cleaning and plating chemicals. Thus, it has been necessary to remove the mask after plating. It has also been difficult, or impossible, to form distinct edges between masked and unmasked portions of a part. Moreover, it has not been uncommon for a masking layer to wear through during a plating cycle, causing undesirable deposition of metal onto masked surface portions.

Thus it has been desired to provide a method of masking a plastic or metal article with a permanent, durable, polymeric layer capable of forming clean edges between masked and unmasked surface areas.

OBJECTS OF THE INVENTION

It is therefore an object of the invention to provide a method of masking a plastic or metal article with a permanent, polymeric layer prior to electrolytic coating. A more particular object is to apply a masking layer that provides well defined edges between plated and masked portions of an article. It is a further object to provide a method of masking a platable substrate with a clear or colored permanent polymeric layer that will withstand plating chemicals and processes without substantial degradation. A further object is to provide a method of masking surface portions of an article for plating, the mask itself being suitable for use as a base coat for paint. Another object is to provide a method of simultaneously masking and providing a protective polymeric surface finish to selected portions of an article prior to plating, the finish being adaptable, as is, to additional manufacturing processes.

BRIEF SUMMARY OF THE INVENTION

In accordance with a preferred embodiment of the invention, surface portions of an injection molded, thermoplastic, acrylonitrile butadiene styrene (ABS) part were successively electrolytically coated with preplate and chrome finish layers. Before preplating, the part was positioned adjacent a paint shield that covered the surface portions to be plated and exposed the surface portions to be coated with the stop-off. Thereafter, a resinous liquid stop-off coating layer was sprayed onto the part surface to completely cover the portions revealed by the paint shield. The coating, by volume percent, was made up of about ten percent by volume of a mixture of 60 weight percent poly(isobutyl methacrylate) resin and 40 weight percent poly(vinyl toluene) resin dissolved in about 90 volume percent solvent. The paint shield was removed and the part baked at a slightly elevated temperature to thoroughly evaporate the solvent and provide the substrate with an adherent, dry layer of solvent-fused poly(isobutyl methacrylate) and poly(vinyl toluene) resins. Thereafter, the part was subjected to a conventional, multi-stage, chrome plating cycle. Extremely well defined edges were formed between the chrome plated and polymer masked portions of the part. No metal was deposited on the surface portions coated with the polymer mixture. I observed that that the plating cycle caused the masking composition to become highly resistant to attack by solvents that would normally dissolve poly(isobutyl methacrylate) and poly(vinyl toluene). Plating did not adversely affect the bond between the masking layer and the ABS substrate. The gloss of the mask coat was somewhat matted by the plating process. The coating was therefore adaptable without further treatment as a base coat for a paint or it could be buffed or polished to a desired gloss level without additional coating. Moreover, the coating was adaptable to other manufacturing processes, such as, for example, sonic or other surface welding techniques. In any case, the mask provided a permanent, protective surface layer for the part.

DETAILED DESCRIPTION OF THE INVENTION

My invention will be better understood in terms of the following specific examples.

EXAMPLE I

A front side marker for a 1979 Oldsmobile Delta 88, including painted housing and bright chrome trim portions, was molded from a platable grade of ABS resin. The part was positioned in a paint shield that covered the surface portions of the marker to be plated. The exposed surface portions were then sprayed with a liquid coating, made up in parts by volume of 9.6 parts of a stop-off polymer mixture. The mixture was made up of 60 weight percent poly(isobutyl methacrylate) and 40 weight percent poly(vinyl toluene) resins. The polymer mixture was dissolved in 90.4 volume parts of a solvent system made up in volume parts of 62.5 parts VM&P naphtha, 24.2 parts mineral spirits, 2.7 parts aromatic petroleum distillates, 1.0 parts butyl alcohol, and less than 0.1 parts silicone fluid for improved coating flow. The coating had a viscosity of 35–39 inches No. 1 Zahn, a specific gravity of 1.04, and was approximately 1 mil thick. The coated part was dried for 10 minutes at 140° F. The dried layer was approximately 0.3 mils thick, had a Tukon hardness of 11, and a specific gravity of 1.04. The gloss of the dried coating, given as a percent reflected light at an incident angle of 60 degrees, was 85%. The coating itself could be characterized as a clear layer of fused poly(isobutyl methacrylate) and poly(vinyl toluene) resins, strongly adhered to the ABS substrate. The part was then pretreated for plating with a strongly acidic, oxidizing solution to render the surface hydrophilic. The surface was neutralized and then treated with a strongly acidic plating activator containing tin and palladium salts.

The part was then subjected to the following plating cycle: caustic soak (pH greater than 11) at 130°-150° F.; electrolytic cleaning at 130°-150° F., 12 volts, 1,500 amps; room temperature water rinse; room temperature dip in 0.2-0.5% sulphuric acid; acid copper strikes at 70°-80° F., 6 volts, 3,000 and 7,500 amps; room temperature sulphuric acid rinse; room temperature clean water rinse; sulphuric acid dip; semibright nickel plate at 130°-140° F., 9 volts, 15,000 amps; bright nickel plate at 140°-150° F., 9 volts, 10,000 amps; durable nickel finish at 120°-130° F., 9 volts, 2,000 amps; room temperature, clean water rinse; chrome plate at 98°-120° F., 9 volts, 15,000 amps; and room temperature, clean water rinse with an anti-tarnish additive.

The plated part had extremely clear definition between the polymer coated and chrome finished surface portions. There was no plate-through of metal onto any of the poly(isobutyl methacrylate)-poly(vinyl toluene) coated surface areas. The gloss level of the resinous layer was decreased approximately 40% by the plating process.

I have discovered that the severe conditions occurring in a normal plastic or metal plating cycle increases the solvent resistance of a poly(isobutyl methacrylate)-poly(vinyl toluene) coating without adversely interfering with its bond to the substrate. I have observed that the plating operation actually increases coating hardness and makes it more impervious to organic solvents. For example, after plating the coating is resistant to gasoline, aliphatic solvents, mineral spirits, aromatic petroleum distillate, butyl alcohol, methylethylketone, naphtha, and toluene. Before plating, the coating is vulnerable to attack by such solvents. The combination of poly(isobutyl methacrylate) and poly(vinly toluene) fused by solvent, heat or other means is resistant to basic and acidic solutions both before and after plating.

After plating, the stop-off coating is readily adaptable for any desired surface finish. If a clear matt finish is desired, the part may be used as is. It is also possible to add a desired coloring agent to the stop-off composition prior to application. After plating, the coating is also particularly adaptable as a base coat for the application of a desired finish plant. If a clear, glossy finish is desired in the stop-off areas, the coating can be buffed or polished after plating.

EXAMPLE II

A molded ABS part like that described in Example I was treated in a like manner with the following exception. An equivalent volume percent (9.6 volume parts resin per 90.4 volume parts solvent) of isobutyl methacrylate was substituted for the combined poly(isobutyl methacrylate) and poly(vinyl toluene) resins. It was found that none of the favorable effects provided by the poly(isobutyl methacrylate)-poly(vinyl toluene) system was provided by the poly(isobutyl methacrylate) alone. The resinous coating material wore away during the plating cycle so that some metal was deposited in the polymer masked areas. Moreover, there was no sharp definition between the methacrylate coated and non-coated portions of the article.

Thus, I have discovered a novel method of electrolytically depositing a metal coating only onto selected surface portions of a platable article. Electroplatable plastics other than ABS can be employed equally well in the practice of the invention. Examples of such plastics include polysulfone, polyphenylene oxide, polypropylene, urea formaldehyde, nylon, phenolic, polycarbonate, polyester, and polystyrene or blends of these resins.

It was also found that the method works equally well on anodically or cathodically platable metal substrates. In particular, steel plating racks used to transport plastic parts between plating operations were coated with the polymeric stop-off composition described in Example I. Even after repeated plating cycles, there was no plate-out on the racks in the areas where the coating had been applied. The poly(isobutyl methacrylate)-poly(vinyl toluene) layer was eventually removed by heating the racks to temperatures above the decomposition temperatures of the polymers.

My invention entails the application of a solvent fused layer of a mixture of poly(isobutyl methacrylate) and poly(vinyl toluene) resins onto selected surface portions of a polymeric or metal article prior to plating. The solvent system used to carry the polymers is not critical to the practice of the invention so long as the resins are completely dissolved, and the solvent can be evaporated prior to plating. The solids content of the coating mixture can be adjusted to obtain a desired viscosity. Colorants and pigments may be added to the coatings prior to application to provide a desired decorative effect. The pigmenting material should be chosen for its resistance to attack in the plating environment.

A coating layer made entirely of poly(isobutyl methacrylate) resin does not provide adequate stop-off characteristics to polymeric or metal substrates. It appears that the properties of excellent stop-off in normal plating environments, good edge definition between plated and unplated surface portions, resistance to chemical attack, and coating permanence, although not provided by either poly(isobutyl methacrylate) or poly(vinyl toluene) resins alone, are created by their interaction.

While my invention has been described particularly in terms of the preceding examples, other embodiments may be readily adapted by one skilled in the art. Therefore my invention is limited only by the following claim.

The embodiments of the invention in which an exlusive property or privilege is claimed are defined as follows:

1. In a method of electrolytically depositing a metal coating onto selected surface portions of an electroplatable metal or polymer substrate comprising the steps of shielding surface portions of the substrate to be electrolytically coated;

applying a polymeric coating layer to surface portions of the substrate exposed by the shielding; and subjecting the substrate to electrolytic deposition such that a layer of metal is deposited on surface portions not covered by the polymeric coating layer;

the improvement wherein the polymeric coating layer comprises a mixture of fused poly(isobutyl methacrylate) resin and poly(vinyl toluene) resin.

* * * * *